US005989047A

United States Patent [19]

Huang

[11] Patent Number: 5,989,047

[45] Date of Patent: Nov. 23, 1999

[54] CHRISTMAS LAMP SOCKET

[76] Inventor: Shun-Feng Huang, No. 13, Lane 84, Nei Hu Road, Hsin Chu City, Taiwan

[21] Appl. No.: 09/136,059

[22] Filed: Aug. 19, 1998

[51] Int. Cl.[6] ..... H05B 37/02

[52] U.S. Cl. ..... 439/252; 315/185 S; 439/699.2; 439/414

[58] Field of Search ..... 439/252, 699.2, 439/414; 315/185 S

[56] References Cited

U.S. PATENT DOCUMENTS 3,208,032 9/1965 Tilesi ..... 439/699.2
3,522,579 8/1970 Matsuya ..... 439/699.2
4,100,448 7/1978 Chipner et al. ..... 439/699.2
5,620,343 4/1997 Pan ..... 439/699.2

*Primary Examiner*—Michael B Shingleton
*Attorney, Agent, or Firm*—Rosenberg, Klein & Lee

[57] ABSTRACT

A Christmas lamp socket includes an inner socket for a lamp to fit therein and an outer shell to hold the inner socket. The inner socket has two supporting base parts defining an intermediate room. The outer shell has an intermediate wall inside and two holding cavities defined by the intermediate wall and an outer wall to retain a respective one of the supporting base parts such that the intermediate wall is received within the intermediate room and forms a pressure upon the supporting base parts for firmly holding leads of a wire between the supporting base parts and the outer shell.

1 Claim, 5 Drawing Sheets

CHRISTMAS LAMP SOCKET

BACKGROUND OF THE INVENTION

This invention relates to a Christmas lamp socket, particularly one consisting of an inner socket and an outer shell whereby leads of a wire can have firm contact with contacts inside the socket by means of the combination of supporting base parts of the inner socket with the corresponding parts of the outer shell contoured to the shape of the supporting base parts.

A known conventional Christmas lamp socket, as shown in FIGS. 4 and 5, which has been issued by the U.S. Patent & Trademark Office with U.S. Pat. No. 5,722,860, includes an inner socket 10 and outer shell 13 as the main parts; the inner socket 10 receives a lamp 1 at upper end portion thereof and has a supporting base 12 at lower end portion thereof. The supporting base 12 has a substantially "H" shaped cross section with guide grooves 121 at two sides. There are several projecting parts 122 on the guide grooves 121. Contacts 11 are disposed at upper portions of two sides of the supporting base 12.

The outer shell 13 has a holding cavity 131 defined by outer wall thereof to receive the inner socket 10 therein such that, referring to FIG. 5, leads 141 of a wire 14 can be each inserted into an aperture between the respective contact 11 and the outer shell 13 with the projecting parts 122 and the outer shell 13 holding the wire 14 in place.

However, because apertures between the supporting base 12 and the outer shell 13 cannot be changed once the socket is made, likely to result in loosening of the connection of the leads 141 to the contacts 11 and eventual loss of power supply to the Christmas lamp.

SUMMARY

The present invention has been devised to offer a kind of Christmas lamp socket, which is an improvement on a heretofore known Christmas lamp socket, such that leads of a wire can be more firmly secured between an inner socket and an outer shell thereof, preventing the leads from losing contact with the respective contacts provided on the supporting base parts.

The inner socket has two supporting base parts defining an intermediate room in between and the outer shell has a cavity contoured to the shape of the inner socket, having an intermediate wall. The inner socket is retained inside the outer shell with the intermediate wall received in the intermediate room, forming a pressure upon the supporting base parts of the inner socket so as to force the same to have a firm connection to the outer shell, greatly securing the contact of leads of a wire with the respective contacts provided on the supporting base parts.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
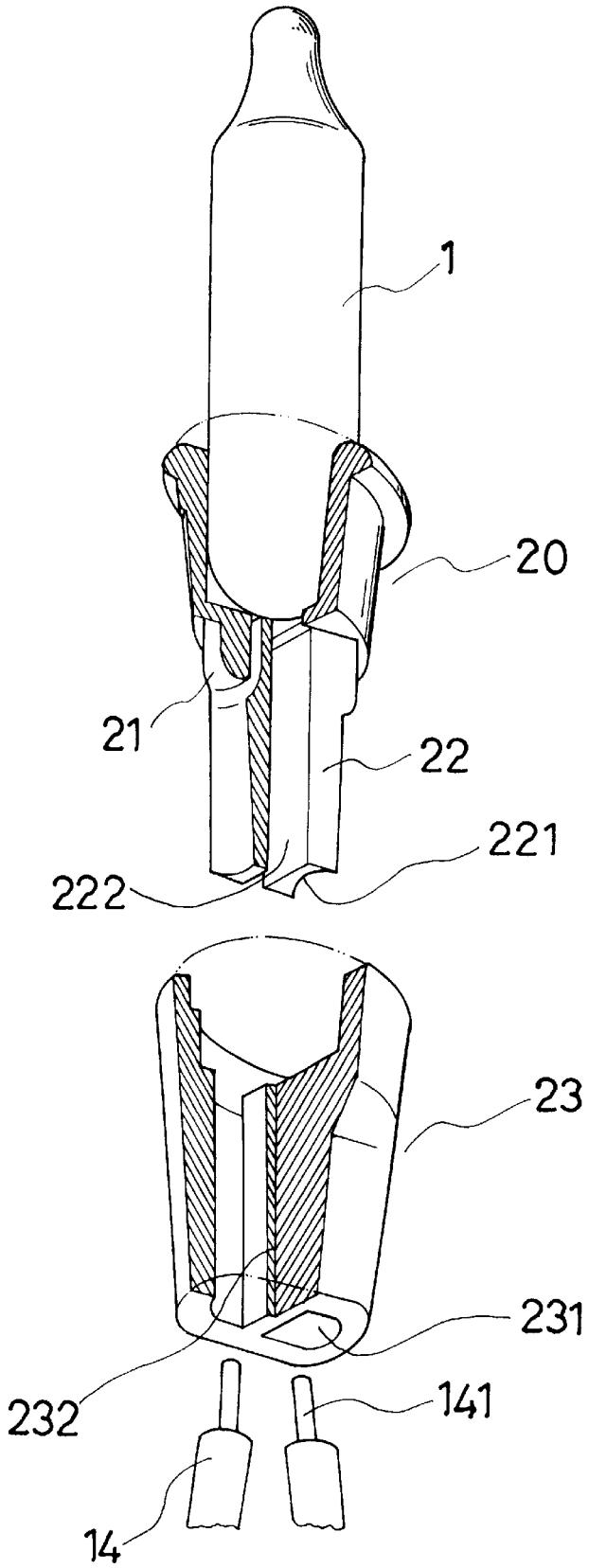
FIG. 1 is an exploded perspective view of a Christmas lamp socket of the present invention.
Figure 3:
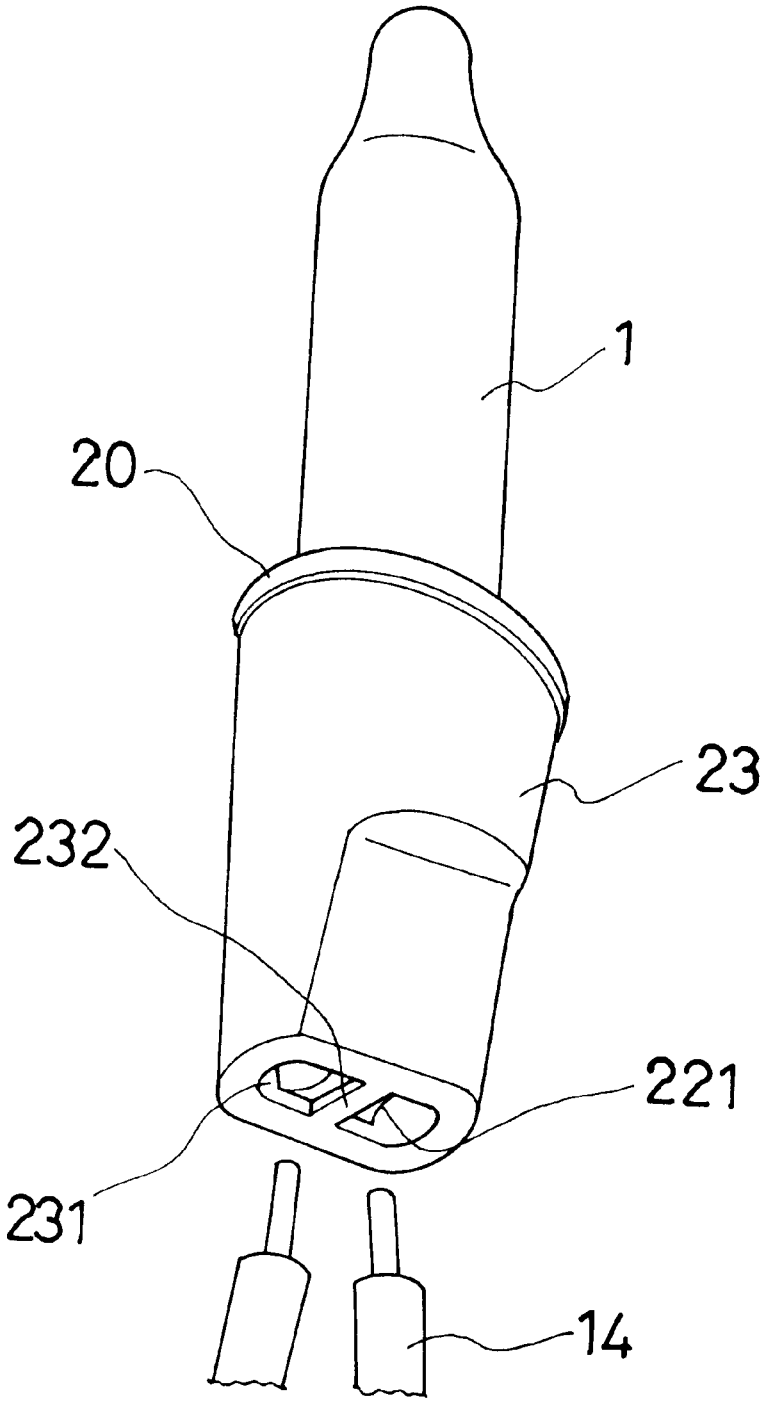
FIG. 3 is a view showing a way of fitting a wire to the Christmas lamp socket of the present invention.
Figure 4:
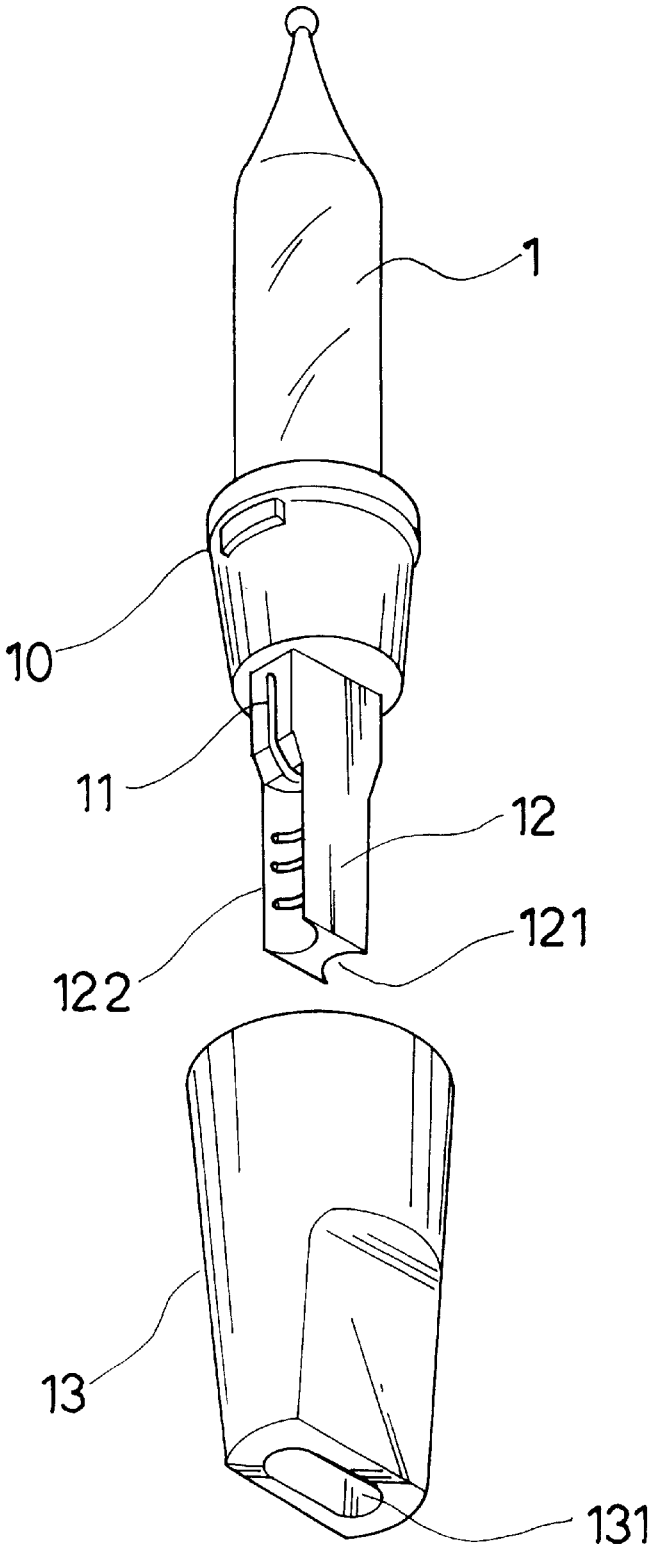
FIG.4 (PRIOR ART)
FIG. 4 is an exploded perspective view of a prior art Christmas lamp socket as described in the Background; and, FIG. 5 is a sectional view of the prior art Christmas lamp socket as described in the Background.
Figure 5:
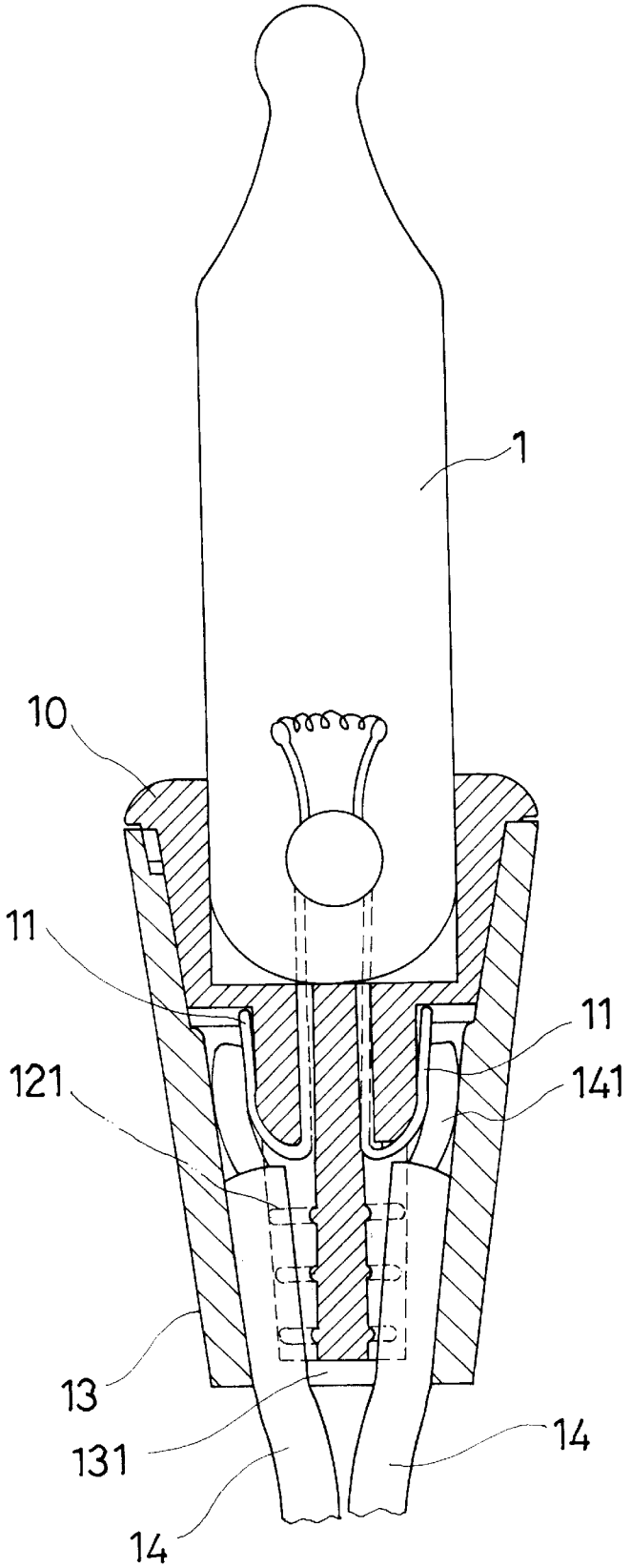
FIG.5 (PRIOR ART)

A Christmas lamp socket of the present invention, referring to FIGS. 1 and 3, includes an inner socket 20, an outer shell 23 as the main parts; the inner socket 20 has a round hole at upper end portion thereof for permitting a lamp 1 to fit therein, two supporting base parts 22 resiliently projecting downward from lower end portion of the inner socket 20 and having each a curvedly shaped guide groove 221 facing outward; an intermediate room 222 is defined by the two supporting base parts 22. The inner socket 20 further has two contacts 21 projecting out downwardly from the upper end portion, bent upwardly so as to be in contact with upper end portions of the supporting base parts 22. The contacts 21 and the connection thereof to the support base parts 22 is similar to those as described in the Background of The Invention and so will not be further detailed here.

The outer shell 23 has an outer shape similar to the corresponding part of the prior art Christmas lamp socket as described in the Background, while the outer shell 23 further has an intermediate wall 232 insides, which, along with outer wall (not numbered) of the outer shell 23, defines two holding cavities 231; the holding cavities 231 are contoured to the shape of the supporting base parts 22.

Figure 2:
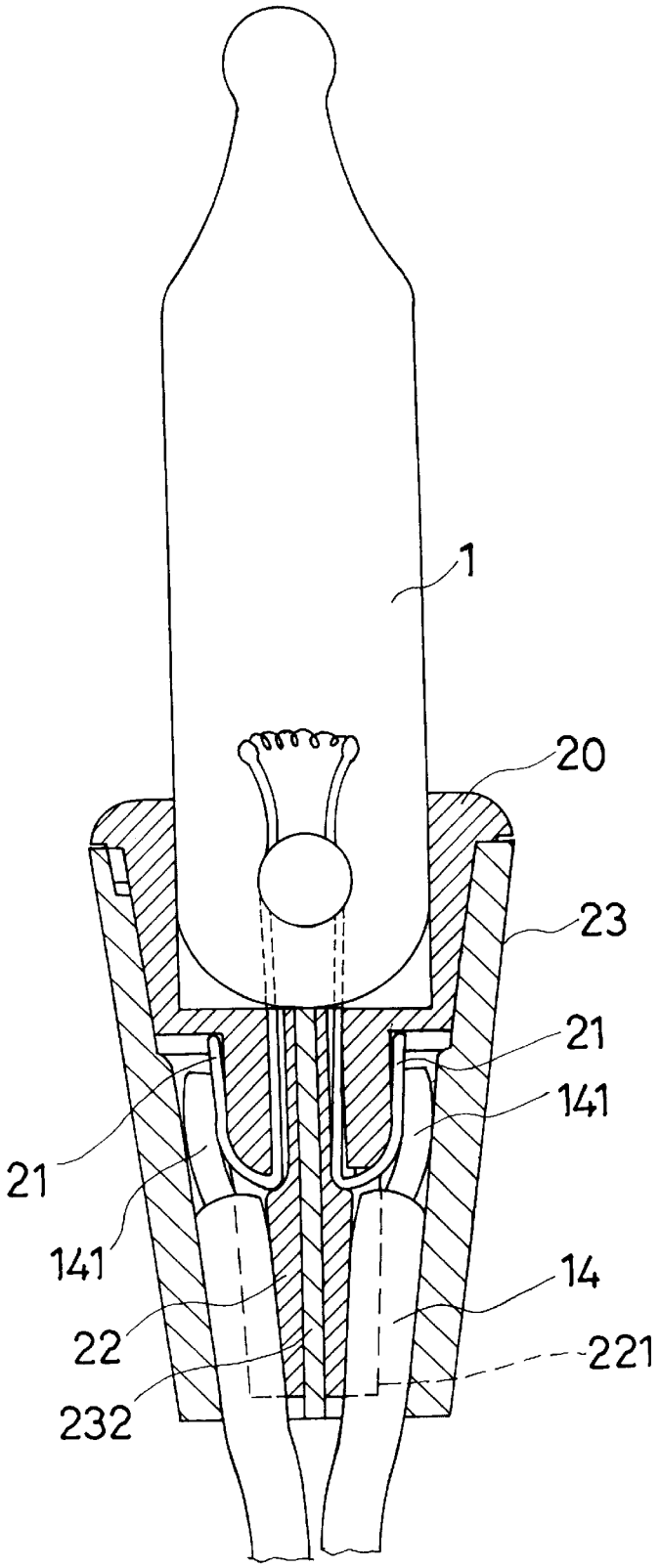
FIG. 2 is a sectional view of the Christmas lamp socket of the resent invention.

In combination, the inner socket 20 is inserted into the outer shell 23 having two leads 141 of a wire 14 each disposed in a respective one of the holding cavities 231, with the supporting base parts 22 each inserted into a respective one of the holding cavities 231; thus, the intermediate wall 232 of the outer shell 23 is firmly retained in the intermediate room 222 at the lower end portion of the inner socket 20 and exerts a pressure upon the supporting base parts 22 outwardly so as to force the leads 141 of the wire 14 to contact the contacts 21 of the inner socket 20 closely and firmly, as shown in FIG. 2.

From the above description, it can be understood that because of the intermediate wall 232 of the outer shell 23 and the intermediate room 222 at the lower end portion of the inner socket 20 in combination, and the holding cavities 231 contoured to the shape of the supporting base parts 22, the leads 141 of the wire 14 can firmly contact the contacts 21 to have a stable power supply in using the Christmas lamp of the present invention, and so it can be understood that the Christmas lamp socket of the present invention has an advantage over the prior art in view of a firm contact and stable power supply.

What is claims is:

1. A socket for a Christmas lamp, comprising:

an outer shell having an open first end and a second end with a pair of openings formed therethrough, said outer shell having a pair of internal cavities defined by an intermediate wall extending from a bottom wall thereof, each of said internal cavities being in open communication with a respective one of said pair of openings;

a pair of wires having respective end portions passing through said pair of openings into said pair of internal cavities, each of said end portions including a bare conductor portion devoid of terminals and an insulated portion; and inner socket disposed in said open first end of said outer shell for holding a lamp, said inner socket having a pair of resilient support members disposed in respective alignment with a pair of leads of the lamp and each extending a substantial distance into a respective one of said pair of internal cavities, said pair of support members being separated one from the other by a gap, each of said resilient support members being wedge shaped, said intermediate wall being received in said gap to outwardly force each of said resilient support members to respectively clampingly engage said insulated portions of said wires and respectively contact said bare conductor portions with said lamp leads.

* * * * *